US007226331B2

(12) United States Patent
Kamata et al.

(10) Patent No.: US 7,226,331 B2
(45) Date of Patent: Jun. 5, 2007

(54) ELECTRON SOURCE MANUFACTURING APPARATUS AND ELECTRON SOURCE MANUFACTURING METHOD

(75) Inventors: Shigeto Kamata, Kanagawa (JP); Kazuhiro Oki, Chiba (JP); Akihiro Kimura, Kanagawa (JP); Kazumasa Takatsu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 226 days.

(21) Appl. No.: 10/957,839

(22) Filed: Oct. 5, 2004

(65) Prior Publication Data

US 2005/0075031 A1 Apr. 7, 2005

(30) Foreign Application Priority Data

Oct. 7, 2003 (JP) ..... 2003-348394

(51) Int. Cl.
*H01J 9/00* (2006.01)
*H01J 9/42* (2006.01)

(52) U.S. Cl. ..... 445/3; 445/6; 445/63

(58) Field of Classification Search ..... 445/3, 445/63, 65, 66, 70, 6; 324/756
See application file for complete search history.

(56) References Cited

U.S. PATENT DOCUMENTS 5,622,634 A 4/1997 Noma et al. ..... 216/40
5,855,637 A * 1/1999 Yakou et al. ..... 65/29.12
6,169,356 B1 1/2001 Ohnishi et al. ..... 313/495
6,344,711 B1 2/2002 Ohnishi et al. ..... 313/495
6,384,541 B1 5/2002 Ohnishi et al. ..... 315/169.3
6,582,268 B1 * 6/2003 Jindai et al. ..... 445/6
6,741,087 B2 5/2004 Kimura et al. ..... 324/754
6,821,180 B2 * 11/2004 Kimura et al. ..... 445/62
6,962,516 B2 * 11/2005 Ohki et al. ..... 445/63
6,997,769 B2 * 2/2006 Saeki ..... 445/70
2002/0193034 A1 * 12/2002 Ota ..... 445/16
2003/0052617 A1 3/2003 Ohki et al. ..... 315/169.3
2004/0152388 A1 8/2004 Kimura et al. ..... 445/24

FOREIGN PATENT DOCUMENTS

JP 7-235255 9/1995
JP 8-171849 7/1996
JP 2002-358875 12/2002
JP 2003-086086 3/2003

* cited by examiner

*Primary Examiner*—Sikha Roy
*Assistant Examiner*—Natalie K. Walford
(74) *Attorney, Agent, or Firm*—Fitzpatrick, Cella, Harper & Scinto

(57) ABSTRACT

In an electron source manufacturing apparatus, the quantity of heat generated from an electron source substrate is measured. A temperature of a support member for the electron source substrate is controlled based on the measured quantity of heat generated. A variation in performances of electron source substrates is suppressed, which increase their life.

1 Claim, 6 Drawing Sheets

ELECTRON SOURCE MANUFACTURING APPARATUS AND ELECTRON SOURCE MANUFACTURING METHOD

BACKGROUND OF THE INVENTION

1. Field of the Invention

The present invention relates to an apparatus for manufacturing an electron source used for a display panel or the like and a method of manufacturing the electron source.

2. Related Background Art

Conventionally, as an electron-emitting device, there are generally known two types, namely, a thermoelectron-emitting device and a cold-cathode electron-emitting device. The cold-cathode electron-emitting device includes a field-emission electron-emitting device, a metal/insulator/metal electron-emitting device and a surface conduction electron-emitting device.

For example, there are surface conduction electron-emitting devices that utilize the phenomenon in which electron emission is caused by allowing an electric current to flow in a thin film formed with a small area on a substrate and in parallel to the film surface. Its basic structure and manufacturing method are disclosed, for example, in Japanese Patent Application Laid-Open No. H7-235255, and Japanese Patent Application Laid-Open No. H8-171849.

The surface conduction electron-emitting device is characterized by including on a substrate a pair of device electrodes opposing each other and an electroconductive film that is connected to the pair of device electrodes and has an electron-emitting region in a part thereof. In addition, a fissure is formed in a part of the electroconductive film and a deposited film containing at least one of carbon and a carbon compound as a main component is formed at the end of the fissure.

A plurality of such electron-emitting devices are arranged on a substrate and are connected to one another by wirings, whereby an electron source provided with the plurality of electron-emitting devices can be manufactured. In addition, a display panel of an image-display apparatus can be manufactured by combining the electron source with a phosphor.

When the electron source is manufactured, for example, a plurality of electroconductive members are formed on a substrate, and the substrate is placed on a support member having a cooling unit and covered with a vacuum chamber. The vacuum chamber includes a closed space formed by the support member and the vacuum chamber using a seal member such as a packing.

Next, after the vacuum chamber is exhausted, a voltage is applied to each of the electroconductive members through external terminals under a depressurized atmosphere to form an electron-emitting region in each of the electroconductive members. At the application of the voltage, heat generated from the substrate is recovered by the support member having the cooling unit.

According to a conventional manufacturing method, a temperature control performed by the support member is an open control. For example, a cooling medium having a predetermined temperature is allowed to flow into the cooling unit of the support member or a temperature of the cooling medium is changed so as to obtain a preset temperature profile.

However, when performances, such as an electron-emitting characteristic and a life, of the manufactured electron source are to be improved, it is necessary to control a temperature of the surface of the substrate with higher precision. In particular, when a variation in resistances of the electroconductive members or wirings connected with the electroconductive members is changed for each substrate, the quantity of heat generated from the surface of the substrate during an electron source manufacturing process is also changed for each substrate. Therefore, it is also required to control the temperature of the surface of the substrate to a predetermined temperature in consideration of the change in the quantity of heat generated.

SUMMARY OF THE INVENTION

An object of the present invention is to control a temperature of a substrate surface to a predetermined temperature in consideration of a change in the quantity of heat generated for each of substrates during an electron source manufacturing process.

Also, another object of the present invention is to improve performances, such as an electron-emitting characteristic and a life, of an electron source.

Further, another object of the present invention is to improve the performances, such as the electron-emitting characteristic and the life, of the electron source and to reduce a variation in performances of the respective substrates.

The present invention relates to an electron source manufacturing apparatus, including:

a support member for supporting a substrate on which a plurality of electroconductive members are arranged;

voltage applying means for applying voltages to the electroconductive members;

the temperature adjusting means for controlling a temperature of the support member; and measurement means for measuring a quantity of heat generated from the substrate; wherein the temperature adjusting means controls the temperature of the support member based on the quantity of heat generated, which is measured by the measurement means.

Further, the present invention relates to an electron source manufacturing method, including:

preparing a substrate on which a plurality of electroconductive members are arranged; and applying voltages to the plurality of electroconductive members to form an electron-emitting region in each of the plurality of electroconductive members, in which the electron-emitting region is formed by the electron source manufacturing apparatus according to claim 1.

Further, the present invention relates to an electron source manufacturing method, including:

locating a plurality of electroconductive members that are arranged on a substrate under a depressurized atmosphere; and applying voltages to the plurality of electroconductive members to form an electron-emitting region in each of the plurality of electroconductive members while a temperature of the substrate is controlled to a predetermined temperature based on a change in a quantity of heat generated from the substrate.

DESCRIPTION OF THE PREFERRED EMBODIMENTS

An electron source manufacturing apparatus of the present invention includes: a support member for supporting a substrate on which a plurality of electroconductive members are arranged; voltage applying means for applying voltages to the electroconductive members; temperature adjusting means for controlling a temperature of the support member; and measurement means for measuring a quantity of heat generated from the substrate; wherein the temperature adjusting means controls the temperature of the support member based on the quantity of heat generated, which is measured by the measurement means.

Also, an electron source manufacturing method of the present invention includes: a step of preparing a substrate on which a plurality of electroconductive members are arranged; and a step of applying voltages to the plurality of electroconductive members to form an electron-emitting region in each of the plurality of electroconductive members, in which the electron-emitting region is formed by the electron source manufacturing apparatus.

Also, an electron source manufacturing method of the present invention includes steps of: locating a plurality of electroconductive members on a substrate under a depressurized atmosphere; and applying voltages to the plurality of electroconductive members to form an electron-emitting region in each of the plurality of electroconductive members while a temperature of the substrate is controlled to a predetermined temperature based on a change in a quantity of heat generated from the substrate.

According to the present invention, (1) it is possible to control a temperature of a substrate surface to a predetermined temperature in consideration of a change in the quantity of heat generated for each of substrates during an electron source manufacturing process, (2) it is possible to improve performances, such as an electron-emitting characteristic and a life, of an electron source, or (3) it is possible to improve the performance, such as the electron-emitting characteristic and the life, of the electron source and to reduce a variation in performances of the respective substrates.

Thus, the electron source manufacturing apparatus and the electron source manufacturing method as described above can be provided.

Next, embodiments of the present invention will be described in detail with reference to the accompanying drawings.

FIRST EMBODIMENT

Figure 1:
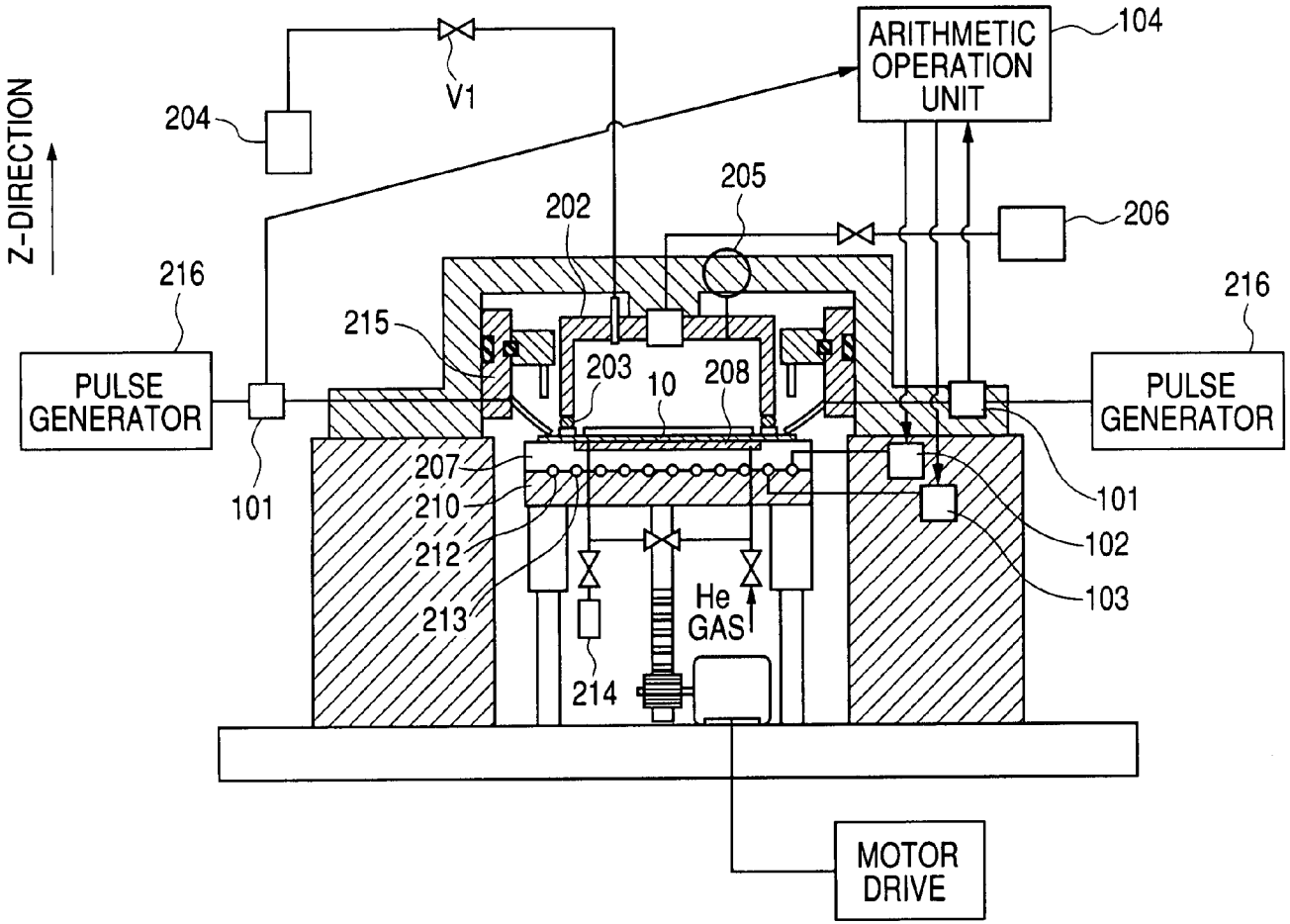
FIG. 1 is a sectional diagram showing an electron source manufacturing apparatus according to a first embodiment of the present invention.

FIG. 1 is a sectional diagram showing an electron source manufacturing apparatus according to a first embodiment of the present invention. In FIG. 1, the electron source manufacturing apparatus includes a vacuum chamber (vacuum container) 202, O-rings (packings) 203, and an ionization vacuum gauge 205 serving as a vacuum meter. Reference numeral 204 denotes benzonitrile serving as an active gas. The electron source manufacturing apparatus further includes a vacuum pumping system (vacuum pump) 206, a substrate support member 207, and an electrostatic chuck 208 provided in the support member 207. The electrostatic chuck 208 fixedly holds a substrate 10. Note that a plurality of electroconductive members is formed on the surface of the substrate 10 as described later.

The electron source manufacturing apparatus further includes a plate 210 which is movable in the longitudinal direction by a motor drive, electrical heaters 212, and cooling units 213. The electrical heaters 212 and the cooling units 213 are alternately arranged. The electron source manufacturing apparatus further includes a vacuum pumping system 214, probe units 215 which can electrically contact with a part of wirings (described later) on the substrate 10, pulse generators 216 connected with the probe units 215, and a valve V1.

The electron source manufacturing apparatus further includes first and second measurement units 101 for measuring the quantities of heat generated from the substrate 10, a power source 102 for temperature adjustment, a water temperature controller 103, and an arithmetic operation unit 104. The first and second measurement units 101 measure the quantities of heat generated using a method described later. As described later in detail, the arithmetic operation unit 104 controls the power source 102 for temperature adjustment and the water temperature controller 103 according to the measured quantity of heat generated to perform heating using the electrical heaters 212 or cooling using the cooling units 213 under control.

Note that, in order to control the electrical heaters 212 and the cooling units 213, temperature sensors (not shown) are located in the support member 207, the electrostatic chuck 208, or the plate 210. An electrical circuit of the electrostatic chuck 208 is not also shown.

Figure 2:
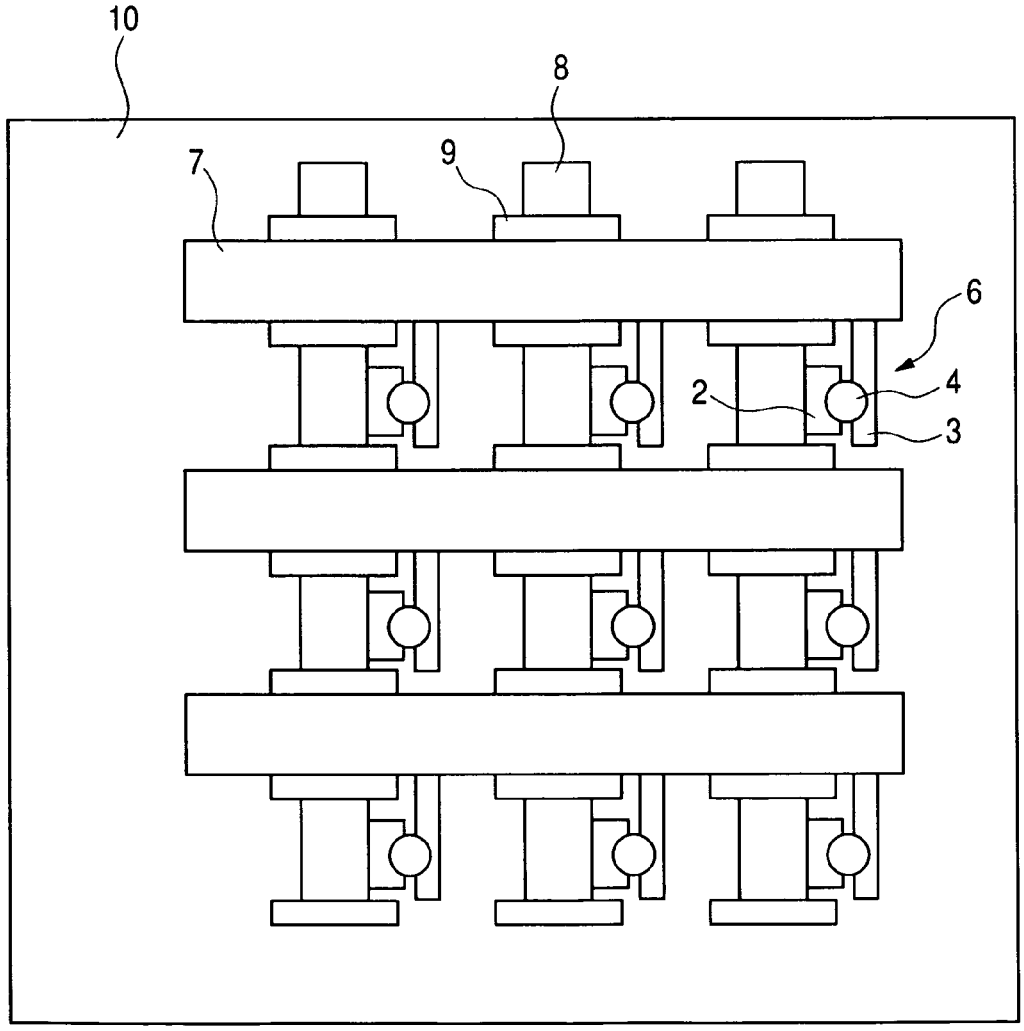
FIG. 2 is a plan view showing an example of an electron source substrate.

FIG. 2 shows an example of the substrate 10. As shown in FIG. 2, a plurality of row-directional wirings (X-directional wirings) 7, a plurality of column-directional wirings (Y-directional wirings) 8, device electrodes 2 and 3 wired in matrix by those wirings, and electroconductive films 4 made of PdO or the like are formed on the surface of a glass substrate to compose the substrate 10. Reference numeral 9 denotes insulating layers. In this embodiment, the electroconductive members, in each of which an electron-emitting region is formed correspond to the electroconductive films 4.

Next, an example of a method of manufacturing an electron source using the manufacturing apparatus shown in FIG. 1 will be described. First, the substrate 10 shown in FIG. 2 is placed on the support member 207 and sucked by the electrostatic chuck 208. Next, a He gas is introduced between the substrate 10 and the support member 207 and maintained to 500 Pa. The He gas has a function for improving heat conduction between the substrate 10 and the electrostatic chuck 208. Although the He gas is most preferable, a gas such as $N_2$ or Ar can be also used. A kind of gas is not limited if desirable heat conduction is realized.

Next, the vacuum chamber 202 is placed above the substrate 10 through the O-rings 203 such that end portions of the wirings protrude from the vacuum chamber 202, thereby forming a vacuum-tight space in the vacuum chamber 202. Vacuum pumping is performed on the vacuum-tight space by the vacuum pumping system 206 until a pressure of the vacuum-tight space becomes equal to or smaller than $1\times10^{-5}$ Pa. A current flowing into the electrical heaters 212 is adjusted by the power source 102 for temperature adjustment, serving as a first temperature adjustment means. A temperature of water flowing into the cooling units 213 is adjusted by the water temperature controller 103 serving as a second temperature adjustment means. The substrate 10 is maintained at a constant temperature of 50° C. The temperature control is performed based on outputs of the above-mentioned temperature sensors (not shown). The electrical heaters 212 and the power source 102 for temperature adjustment may be omitted.

Next, the probe units 215 are brought into electrical contact with the end portions of the wirings on the substrate 10, which are exposed to the outside of the vacuum chamber 202. Triangular pulses each having a base length of 1 msec., a pulse period of 10 msec., and a peak value of 10 V are applied to the electroconductive films 4 for 120 seconds under a depressurized atmosphere by each of the pulse generators 216 connected with the probe units 215, thereby performing a forming operation step. Heat generated by a current flowing during the forming operation is efficiently absorbed in the electrostatic chuck 208. The substrate 10 is maintained at the constant temperature of 50° C., so that preferable forming operation can be performed.

Figure 4:
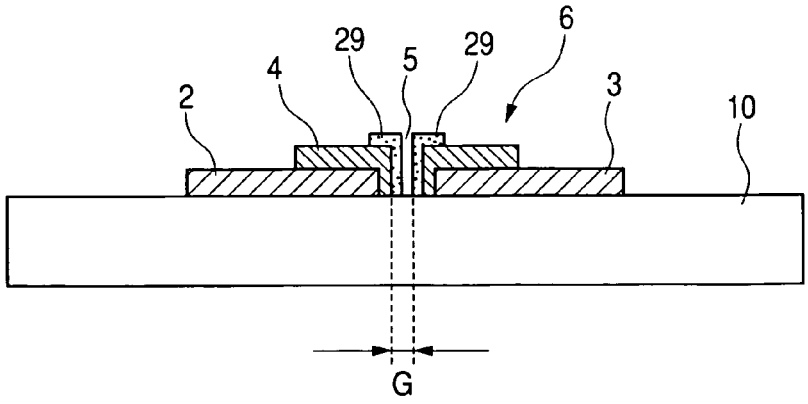
FIG. 4 is a sectional view along a 4-4 line shown in FIG. 3.

According to the forming operation, a gap G is defined between the electroconductive films 4 as shown in FIG. 4.

Figure 3:
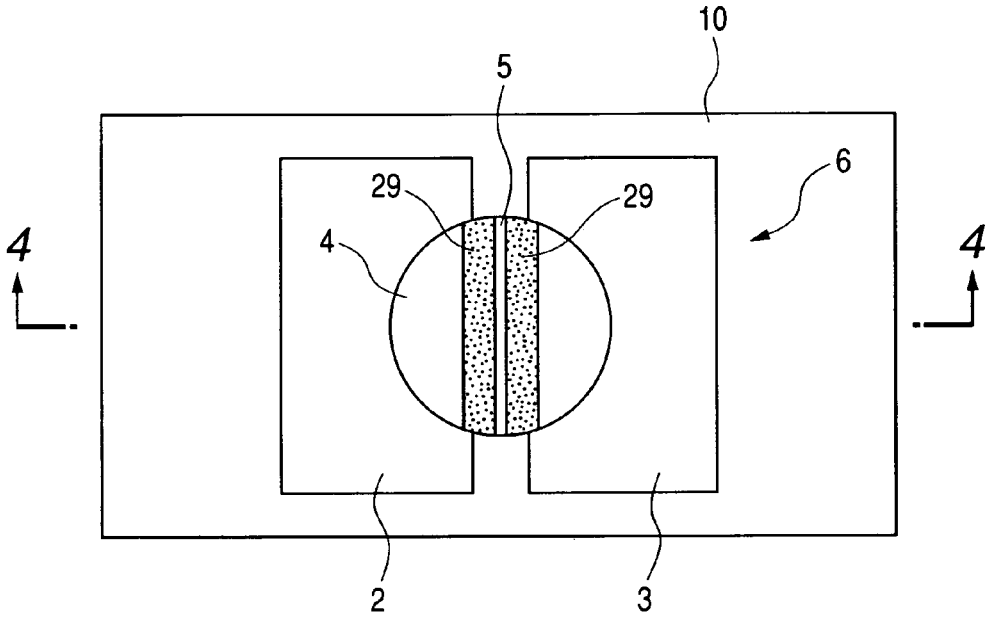
FIG. 3 is a plan view showing an electron-emitting device according to the present invention.

Here, FIG. 3 is a plan view showing an electron-emitting device on the substrate and FIG. 4 is a sectional view taken along the 4-4 line of FIG. 3. In FIGS. 3 and 4, the same reference numerals are given to the same portions as those in FIG. 2. Reference numeral 5 denotes electron emitting portion.

Next, a current flowing into the electrical heaters 212 is adjusted and a temperature of water flowing into the cooling units 213 is adjusted. The substrate 10 is maintained at a constant temperature of 80° C. The temperature control is also performed based on the outputs of the above-mentioned temperature sensors. The valve V1 is opened and benzonitrile is introduced into the vacuum chamber 202 at a pressure of $2\times10^{-4}$ Pa while the pressure of the vacuum-tight space is measured by the ionization vacuum gauge 205. In addition, triangular pulses each having a base length of 1 msec., a pulse period of 10 msec., and a peak value of 15 V are applied to the electroconductive films 4 for 60 minutes under the depressurized atmosphere by each of the pulse generators 216 through the probe units 215, thereby performing activation operation.

In the activation operation, as described later, the first and second measurement units 101 calculate quantities of heat generated Q from the substrate 10. The arithmetic operation unit 104 instructs the power source 102 for temperature adjustment to adjust the temperature of the support member according to the obtained quantity of heat generated Q. Alternatively, the arithmetic operation unit 104 instructs the water temperature controller 103 to control the temperature of the cooling medium according to the obtained quantity of heat generated Q.

With respect to a method of calculating the quantity of heat generated Q, for example, the first measurement unit 101 measures a voltage value V2 across both ends of a resistor which is provided in the first measurement unit 101 and has a resistance value R and calculates a quantity of heat generated Q1(=R/V2) based on the measured voltage value V2. Similarly, the second measurement unit 101 measures a voltage value V3 across both ends of a resistor which is provided in the second measurement unit 101 and has a resistance value R and calculates a quantity of heat generated Q2(=R/V3) based on the measured voltage value V3. In this case, assume that the total quantity of heat generated Q is expressed by Q=Q1+Q2.

The arithmetic operation unit 104 performs control so as to reduce the temperature of the cooling medium with an increase in the quantity of heat generated Q. For example, when the quantity of heat generated Q is increased by 1 kW, the water temperature is reduced from 80° C. to 70° C. by 10° C. When the quantity of heat generated Q is increased by 2 kW, the water temperature is reduced from 80° C. to 60° C. by 20° C.

Figure 6:
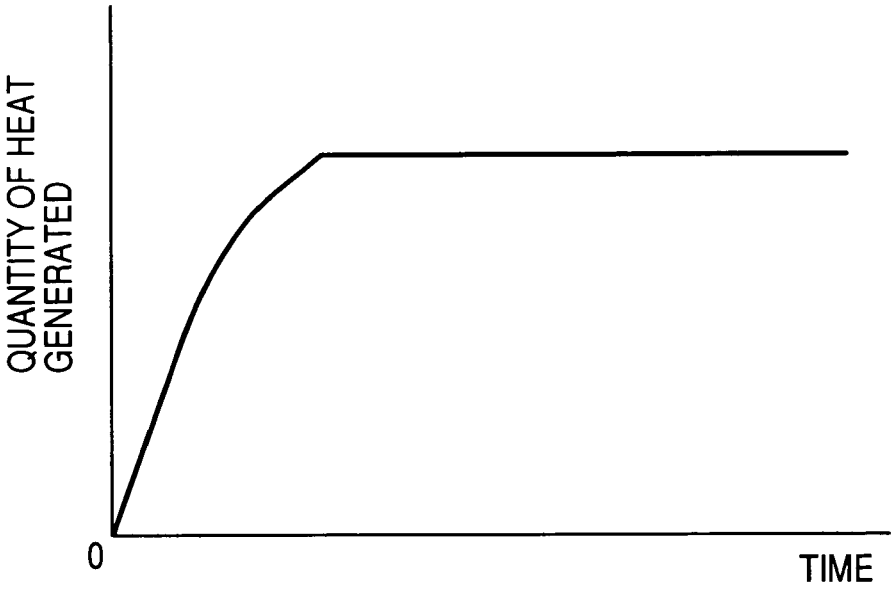
FIG. 6 is a graph showing an example of heating of the electron source substrate according to the present invention.
Figure 7:
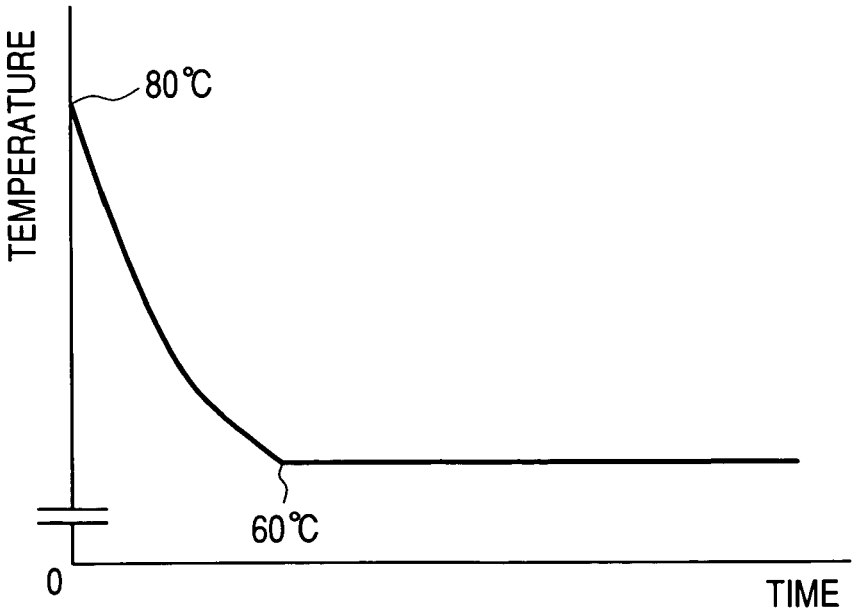
FIG. 7 is a graph showing an example of an indication temperature of an arithmetic operation unit according to the present invention.

For example, when the quantity of heat generated changes as shown in FIG. 6, an instruction is sent to the power source 102 for temperature adjustment or the water temperature controller 103 such that the temperature of the substrate surface is changed from 80° C. to 60° C. in proportion to the quantity of heat generated as shown in FIG. 7. Therefore, the substrate surface can be maintained at a constant temperature. That is, the above-mentioned control is performed in the activation operation because the quantity of heat generated from the surface of the substrate 10 is large, so that the substrate 10 is maintained at the constant temperature.

In this embodiment, the example in which the substrate surface is maintained at the constant temperature is described. However, the present invention is not limited to the example. For example, the control may be performed such that the initial temperature of the substrate is defined as a temperature T1 and gradually increased to a temperature T2. The electrical heaters 212 and the power source 102 for temperature adjustment may be omitted.

As in the forming processing step, heat generated by a current flowing during the activation operation is efficiently absorbed in the electrostatic chuck 208. The substrate 10 is maintained at the constant temperature of 80° C., so that preferable activation can be performed.

According to the activation operation, carbon films 29 are separately formed to have the gap G as shown in FIGS. 3 and 4.

Next, the substrate 10 in which the above-mentioned process is completed is aligned with a face plate in which a glass frame and a phosphor are located. Seal bonding is performed using low melting glass to produce a vacuum envelope. Then, the envelope is subjected to steps such as a vacuum pumping step, a baking step, a sealing step, thereby manufacturing a display panel of an image display device as shown in FIG. 5.

Figure 5:
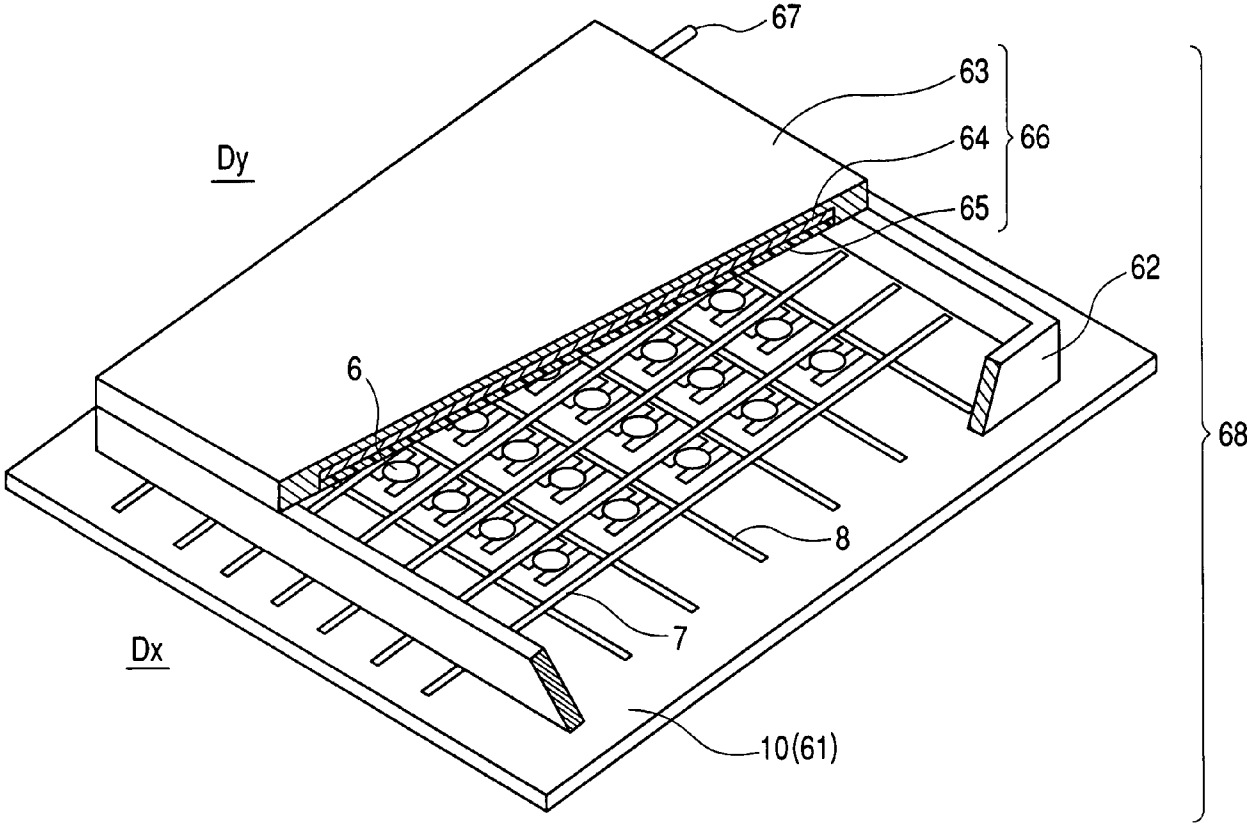
FIG. 5 is a partially cutout perspective view showing an example of an image forming apparatus using an electron source.

FIG. 5 is a perspective view showing the display panel of the image display device, which is partially cut out. A display panel 68 of the image display device includes electron-emitting devices 6, the substrate 10, a rear plate 61 to which the substrate 10 is fixed, a support member 62, a face plate 66, and a high voltage terminal 67. The face plate 66 is composed of a glass substrate 63, a metal back 64, and a phosphor 65.

In the display panel of the image display device as shown in FIG. 5, a scanning signal and a modulation signal are applied from signal generating means (not shown) to each of the electron-emitting devices 6 through external envelope terminals Dx1 to Dxm and Dy1 to Dyn. An electron is emitted from each of the electron-emitting devices 6 by the signal application. A high voltage of 5 kV is applied to the metal back 64 or a transparent electrode (not shown) through the high voltage terminal 67. An electron beam is accelerated by the high voltage application and collides with the phosphor 65. Then, the phosphor 65 is excited to emit light, thereby displaying an image. As a result, performances, such as an electron-emitting characteristic and a life, of the electron source can be improved. In addition, a variation in performances of respective substrates can be reduced.

SECOND EMBODIMENT

Figure 8:
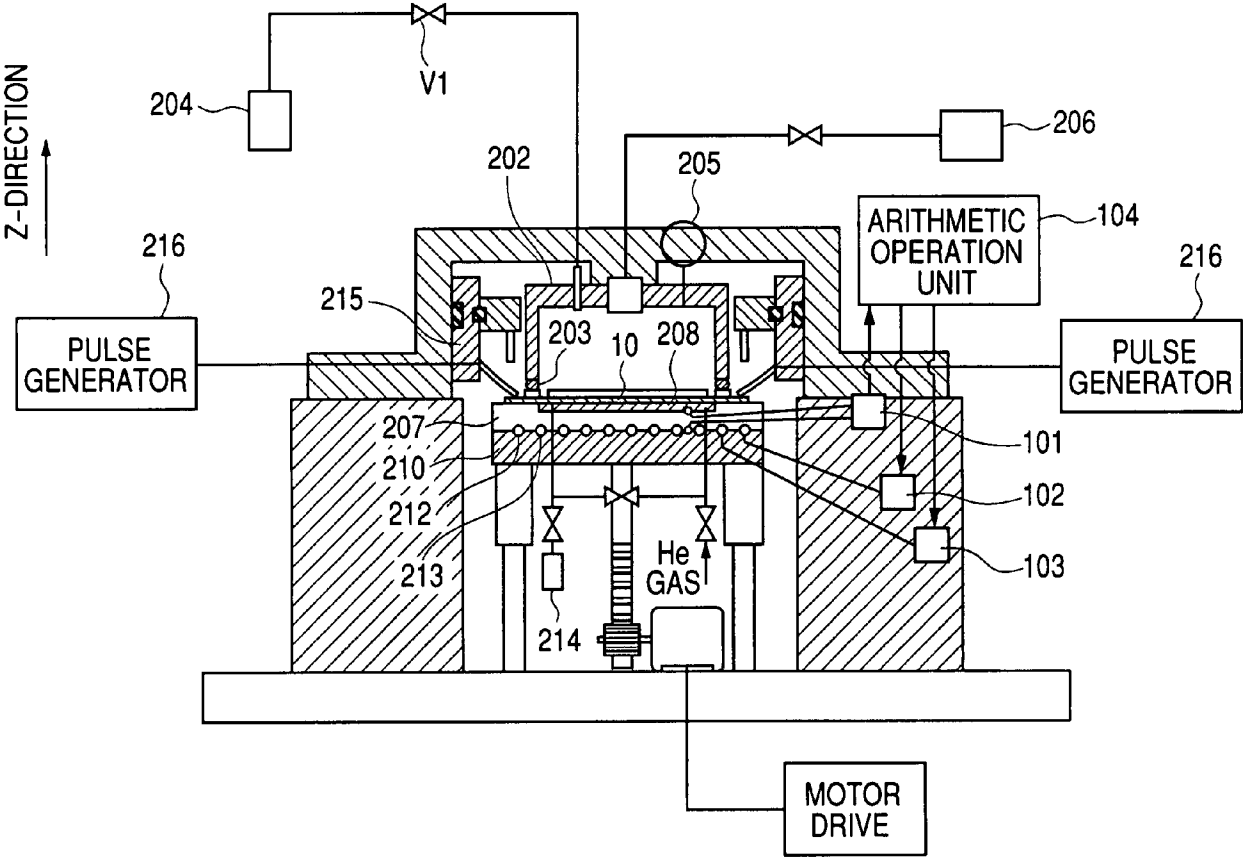
FIG. 8 is a sectional diagram showing an electron source manufacturing apparatus according to a second embodiment of the present invention.

FIG. 8 is a sectional diagram showing an electron source manufacturing apparatus according to a second embodiment of the present invention. The structure of the apparatus as shown in FIG. 8 and the operation thereof are similar to the apparatus as shown in FIG. 1 and the operation thereof. Note that temperatures are measured by a measurement unit 101 composed of temperature sensors which are provided at two points in the support member 207. The quantity of heat Q flowing between the two points at which the temperature sensors are provided is calculated from a temperature difference ΔT between the temperatures measured at the two points and assumed to be the quantity of heat generated Q from the substrate 10.

As in the first embodiment, the arithmetic operation unit 104 instructs the power source 102 for temperature adjustment on the temperature of the support member according to the quantity of heat generated Q. Alternatively, the arithmetic operation unit 104 instructs the water temperature controller 103 on the temperature of the cooling medium according to the quantity of heat generated Q. When thermal conductivity between the two points and a distance therebetween are given by α and X, respectively, and an area of a heating region is given by S, the quantity of heat Q flowing between the two points is expressed by $Q=\alpha\times\Delta T\times S/X$. The temperature sensors composing the measurement unit may be provided in the electrostatic chuck 208. Assume that a plurality of materials are located between the two points at which the temperature sensors are provided. In this case, when thermal conductivity of each of the materials, a distance between the materials, and a temperature difference between the materials are given by αi, Xi, and ΔTi (i=1, 2, . . . ), respectively, the quantity of heat Q flowing between the materials is expressed by $$Q=\alpha i\times\Delta Ti\times S/Xi \quad (i=1, 2, \ldots)$$

Because $\Delta T=\Sigma(\Delta Ti)$, the quantity of heat Q is expressed by $$Q=\Delta T\cdot S/\Sigma(Xi/\alpha i)$$

The same effect as those in the first embodiment is obtained.

This application claims priority from Japanese Patent Application No. 2003-348394 filed on Oct. 7, 2003, which is hereby incorporated by reference herein.

What is claimed is:

1. An electron source manufacturing method, comprising the steps of:

locating a plurality of electroconductive films on a substrate to be disposed on a supporting member under a depressurized atmosphere; and applying voltages to the plurality of electroconductive films while a temperature of the substrate is controlled to be at a predetermined temperature so as to form an electron-emitting region in each of the plurality of electroconductive films, wherein said step of applying voltages is conducted while controlling the substrate to be at the predetermined temperature based on a change of a quantity of heat flowing through the supporting member determined based on temperature values sensed by two or more temperature sensors disposed on the supporting member at positions spaced from each other in a thickness direction of the supporting member and disposed outside of the depressurized atmosphere.

* * * * *